United States Patent [19]

Schörling

[11] 4,226,403

[45] Oct. 7, 1980

[54] OVERLOAD PROTECTION DEVICE IN AIR-OPERATED LIFTING DEVICES

[75] Inventor: Stefan H. G. Schörling, Linköping, Sweden

[73] Assignee: Atlas Copco Aktiebolag, Nack, Sweden

[21] Appl. No.: 961,885

[22] Filed: Nov. 17, 1978

[30] Foreign Application Priority Data

Nov. 25, 1977 [SE] Sweden ..... 7713335

[51] Int. Cl.[3] ..... B66D 1/48

[52] U.S. Cl. ..... 254/273

[58] Field of Search ..... 254/172, 173 R; 192/2

[56] References Cited

U.S. PATENT DOCUMENTS

| | | | |
|---|---|---|---|
| 1,019,851 | 3/1912 | Single . | |
| 2,512,055 | 6/1950 | Dillon | 254/173 R |
| 2,908,853 | 10/1959 | Laky | 254/173 R |
| 3,309,066 | 3/1967 | Carlson | 254/173 R |

*Primary Examiner*—Edward J. McCarthy

*Attorney, Agent, or Firm*—Frishauf, Holtz, Goodman & Woodward

[57] ABSTRACT

An overload protection device for preventing excess of allowed workload in air-operated lifting devices. A braking device is associated with a drum around which a wire is wound. Upon actuation of a control valve which controls the supply of air to a drive motor, the braking device is released. If the lifting device is overloaded, then a main valve is adjusted by means of a load sensing device and the braking device is applied by venting through the main valve.

7 Claims, 9 Drawing Figures

OVERLOAD PROTECTION DEVICE IN AIR-OPERATED LIFTING DEVICES

The present invention relates to an overload protection device for preventing excess of allowed workload in air-operated lifting devices, such as winches, which comprise a drum for carrying a wire wound thereround, a motor for driving the drum, a control valve for controlling the supply of compressed air to the motor, and a braking device associated with the drum which braking device is released upon actuation of the control valve.

SUMMARY OF THE INVENTION

An object of the present invention is to provide an overload protection device in which the braking device is applied at the same time as the motor is stopped.

Another object of the invention is to provide an overload protection device which is restored automatically if it has become operational due to dynamic additional forces being superposed upon a static force which is below the allowed workload.

A further object of the invention is to make possible lowering of the load even if the overload protection device is not restored upon becoming operational.

BRIEF DESCRIPTION OF THE DRAWINGS

The invention is described in the following description with reference to the accompanying drawings in which one embodiment is shown by way of example. It is to be understood that this embodiment is only illustrative of the invention and that various modifications thereof may be made within the scope of the claims following hereinafter.

In the drawings.

DETAILED DESCRIPTION OF PREFERRED EMBODIMENT

Figure 1:
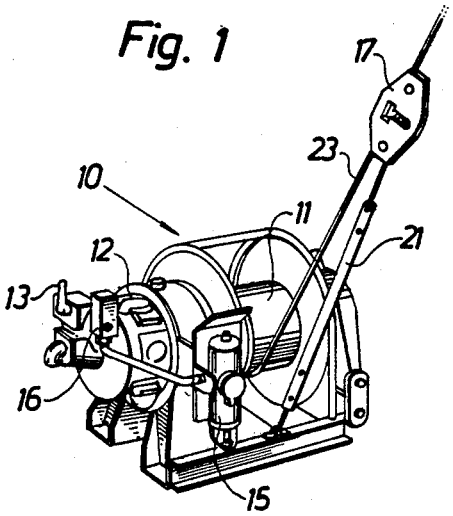
FIG. 1 shows a perspective view of a winch having an overload protection device according to the invention.
Figure 2:
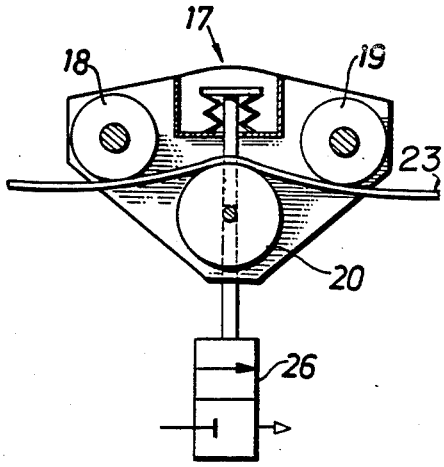
FIG. 2 shows diagrammatically a side view of a load sensing device included in the overload protection device.

In FIG. 1, a winch generally denoted by 10 comprises a drum 11, a pneumatic motor 12 for driving the drum 11 and a control valve 13 for controlling the supply of compressed air to the motor 12. A valve unit 16 is coupled between a lubricator 15 connected to a compressed air source 14 and the control valve 13.

A wire 23 wound on the drum 11 runs through a load sensing device 17. The load sensing device is mounted on an arm 21 and comprises two fixed wheels 18, 19 and a wheel 20 which is movable perpendicular to the longitudinal direction of the wire 23. The wheel 20 is movable against an adjustable spring force.

The winch 10 comprises a braking device 22 which is applied automatically against the drum 11 by spring action when the supply of compressed air to the motor 12 is cut off. The braking device 22 is released by supplying compressed air thereto.

Figure 3:
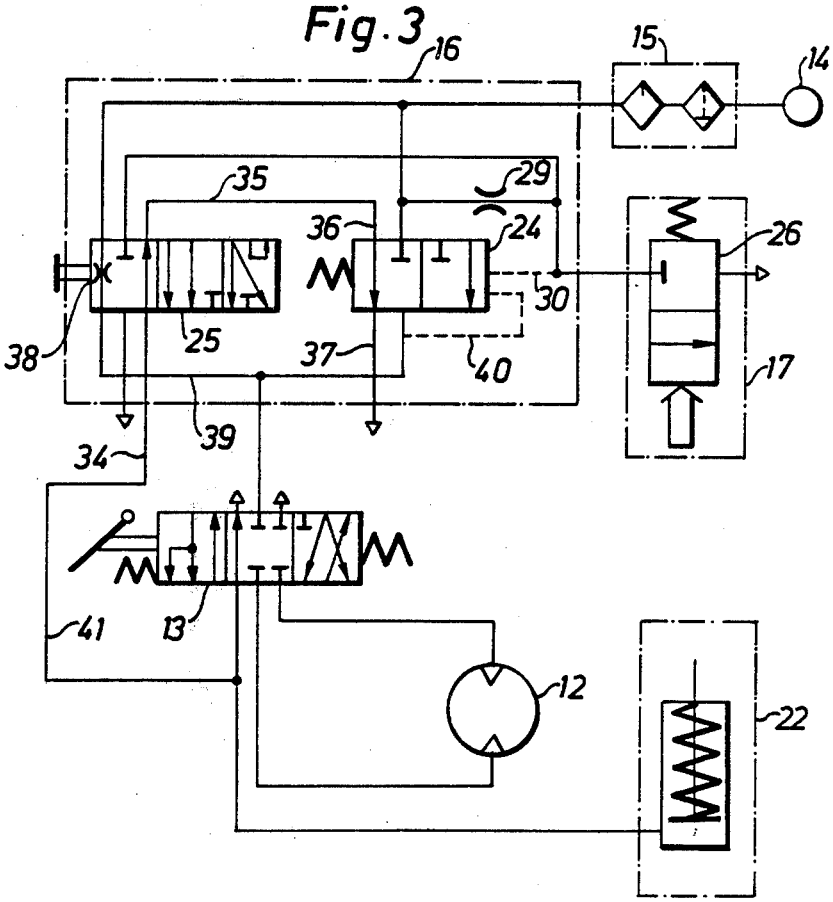
FIG. 3 illustrates the pneumatic circuitry of the winch in FIG. 1.

The valve unit 16 comprises a main valve 24 and an auxiliary valve 25 coupled parallel with the main valve. The auxiliary valve 25 can be adjusted manually between three different positions. Normally, the auxiliary valve is in its inner position shown in FIG. 3. During normal operating conditions, i.e. when the workload is smaller than the maximum allowed load, a valve 26 included in the load sensing device 17 is closed, see FIG. 3.

When the winch 10 is connected to the compressed air source 14 air flows to the inlet 27 of the main valve 24. Control air is conducted from the inlet 27 to the right side of a piston 31, FIG. 4, via a passage 28, a restriction 29 and passages 30, 48. Then, the main valve 24 is adjusted to its position not shown in FIG. 3, which causes a valve body 32 to open thereby allowing compressed air to flow from the inlet 27 to an outlet 33 which communicates with the control valve 13. Thus, the motor 12 can be regulated and the braking device 22 released by means of the control valve 13.

Suppose the allowed load be exceeded. The valve 26 then opens which causes the main valve 24 to be adjusted to its position shown in FIG. 3, wherein the valve body 32 closes. The braking device 22 is vented via the auxiliary valve 25 and the main valve 24 through passages 34, 35, see FIG. 6, and passages 36, 37, see FIG. 4. The load, thus, is maintained hanging on the wire 23 in a braked state.

If the valve 26 has opened due to dynamic additional forces and if the load is so small that the valve 26 closes after that the swinging which causes these additional forces has stopped, then the following happens. If the load is comparatively heavy, i.e. if the biassing force between valve body and valve seat in the valve 26 is small, then air leaks through the valve 26. A pressure cannot be built up of a magnitude large enough to open the valve body 32 in the main valve 24. Provided that the control valve 13 is closed the air which leaks through the auxiliary valve 25 via the passage 28, the restriction 38 and the passage 39, see FIG. 6, will build up a pressure on the right-hand side of the valve body 32, as illustrated by means of a control conduit 40 in FIG. 3. The result is that this additional force behind the valve body 32 together with the reduced compressed air force which acts on the right-hand side of the piston 31 due to the reduced pressure which is built up in the passage 30 will open the valve body 32. If the control valve 13 is open then the air leaks further through the motor 12 and, mainly, through the conduit 41, the auxiliary valve 25 and the passage 37 in the main valve 24 so that no pressure can be built up on the right-hand side of the valve body 32.

The restrictions 29, 38 in combination give a suitable time delay to open the main valve 24 when the control valve is closed.

If the workload is heavier than the return force which acts on the valve 26, then the wire 23 has to be unloaded. In order to make possible a lowering of the workload, the auxiliary valve or the regulating screw 25 is adjusted. If the regulating screw 25 is unscrewed fully to its outer end position, see FIG. 8, the following happens. The air flows through the passages 28, 39 to the control valve 13 and through the passages 28, 34 and the conduit 41 to the braking device 22. When the control valve 13 is in its neutral position, then the braking device is vented through the brake air venting of the control valve. If the control valve 13 now is opened for lowering of the load by moving it for example to the right in FIG. 3, then the control valve cuts off the brake air venting which means that the braking device 22 is released mainly by compressed air through the passage 34. The load, then, is lowered at a suitable speed. The motor 12 and to some extent the braking device 22 also receive air through the passages 28, 39. If the control valve 13 is opened more so that the flow to the motor 12 increases, the pressure to the braking device 22 decreases which means that the braking device starts being applied. The load is then lowered more slowly.

Figure 7:
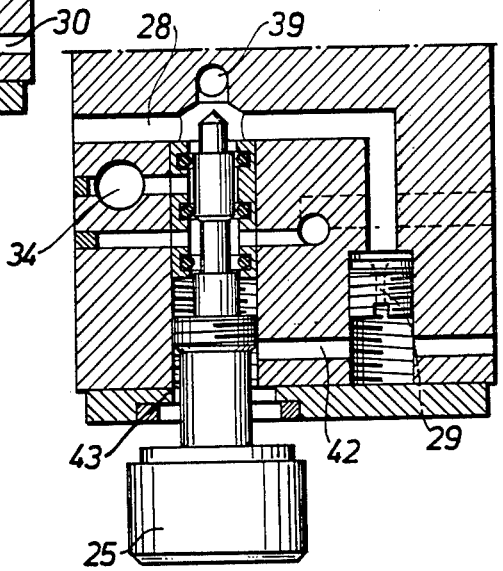

A slow lowering is also achieved if the regulating screw 25 is unscrewed halfway to the position shown in FIG. 7. The braking device 22 is now released solely by means of the compressed air which is supplied through the control valve 13 via the passages 28, 39. Simultaneously, this air drives the motor 12. The passage 34 is now sealed off by means of the regulating screw 25.

Figure 4:
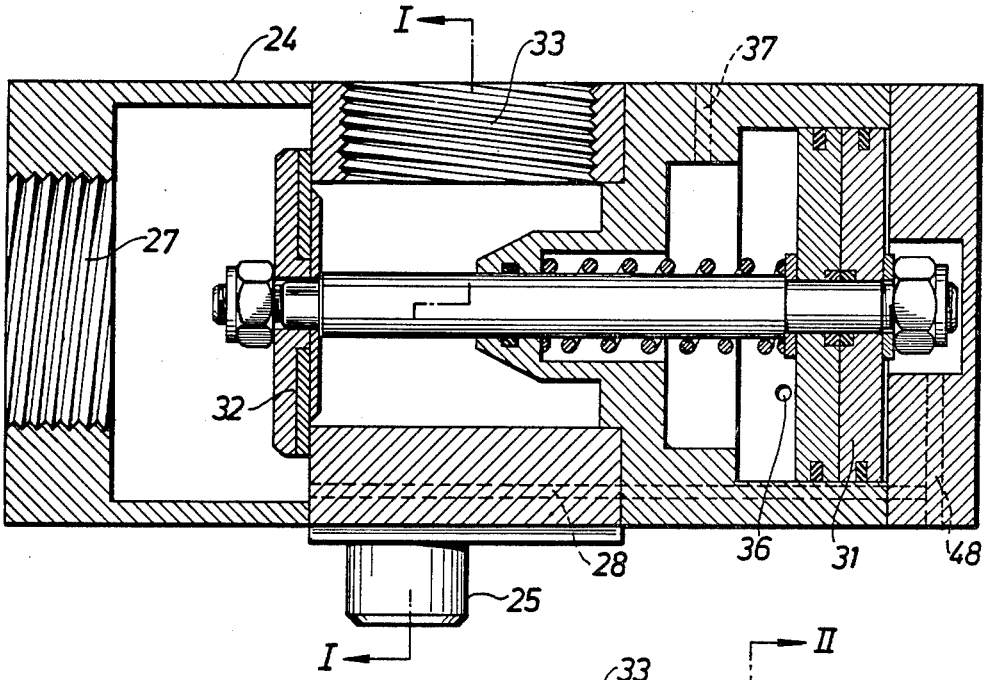
FIG. 4 shows in section a main valve which is actuated by signals from the load sensing device.
Figure 5:
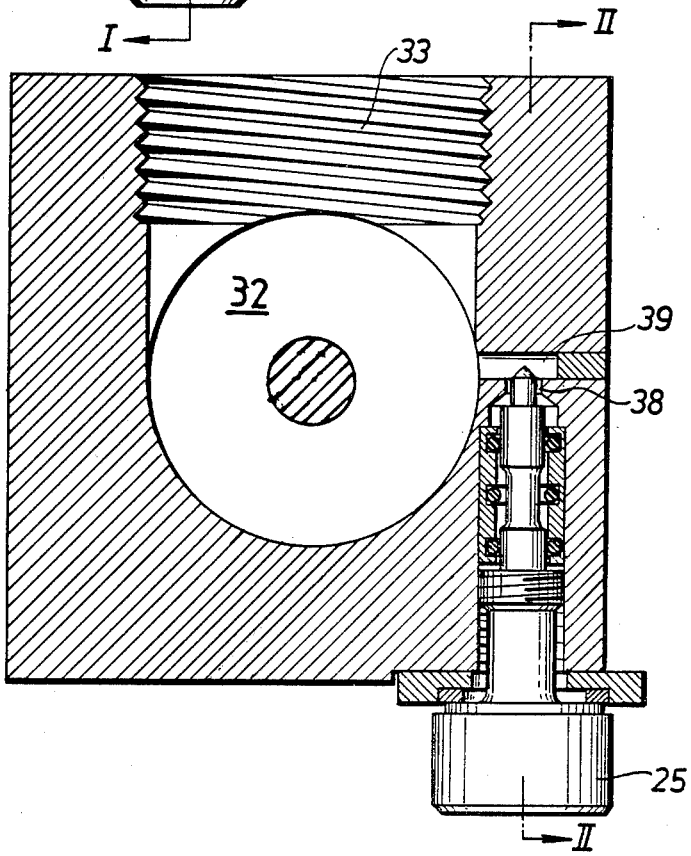
FIG. 5 is a section through the main valve taken along the line I—I in FIG. 4.
Figure 6:
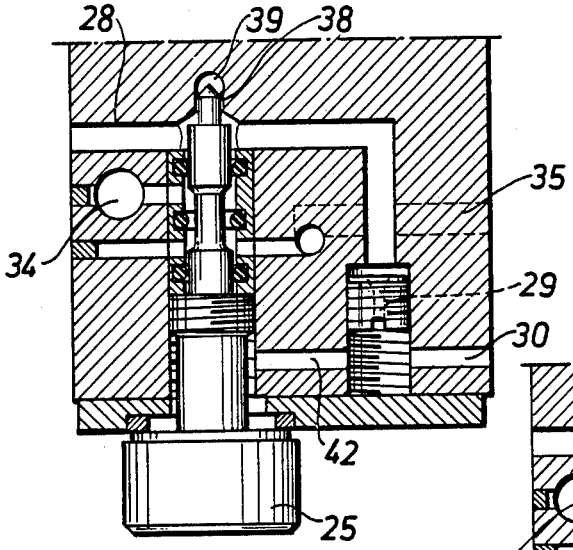
FIGS. 6–8 are sections taken along the line II—II in FIG. 5 through an auxiliary valve in different positions which valve is included in the pneumatic circuitry.
Figure 8:
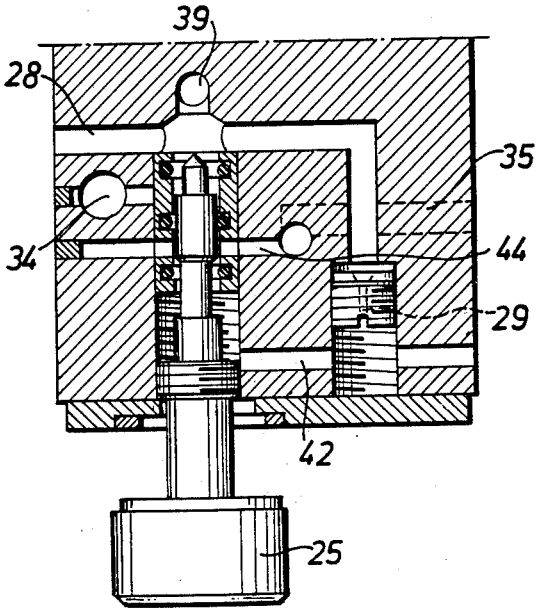

The amount of compressed air which is supplied through the passages 28, 39 is not large enough to lift the load when the regulating screw 25 is in any of its positions shown in FIGS. 7 and 8, because venting simultaneously occurs through respectively the restriction 29, the passage 42 and the slit 43, FIG. 6, and the restriction 29, the passages 42, 44, 35, 36, and 37, FIGS. 8 and 4.

When the wire is deloaded the regulating screw 25 must be fully screwed home in order to cause the main valve 24 to open. When the regulating screw is not fully screwed home, namely, the control conduit 30 is vented through respectively the passage 42 and the slit 43, FIG. 7, and the passages 42, 44, 35, 36 and 37, FIGS. 8 and 4.

Figure 9:
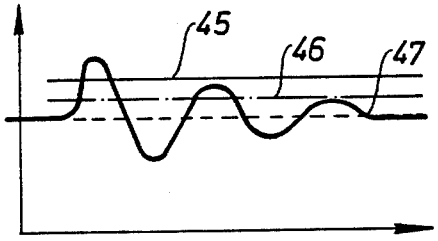
FIG. 9 shows different settings of the load sensing device.

FIG. 9 illustrates the load, on the Y-axis, as function of the time, on the X-axis, during a lifting course where the load first is hanging in space, then is accelerated rapidly and finally is stopped. If the load sensing device 17 is to be set in such a way that the line 47 defines the working load of the winch, i.e. maximum allowed workload, then the load sensing device 17 is set to release by a solely static force according to the line 45. Then, in practice, the following occurs. A static load according to the line 47 can be lifted with normal dynamic additional forces. However, if heavy dynamic additional forces cause the load sensing device 17 to release, then, the load remains hanging in a braked stated. The operator then is warned that the load is in the vicinity of the maximum allowed load and that the dynamic additional forces were to high. If the control valve 13 then is adjusted to its neutral position, then again the main valve 24 is opened, whereupon it once again is possible to move the load.

If the load sensing device 17 is set to release by a solely static force according to the line 46, then only small dynamic additional forces are allowed. In practice loads ranging up to the line 46 can be lifted if the lifting operation is carried out very cautiously. Upon having been released, the load sensing device 17 returns though the load is hanging. The return of the load sensing device, however, occurs in a greater time delay. In practice, loads ranging above the line 46 can never be lifted because in that case allowed additional dynamic forces are so small that they are exceeded when the load is raised from the ground.

In most cases lowering by means of the regulating screw 25 is necessary only very small distances; in order to unload a stretched wire or lower the load some centimeters. In doing so, the regulating screw is unscrewed halfway out. The load, then, can be lowered very slowly by means of the control valve 13.

If, however, the load has to be lowered a longer distance at somewhat higher speed, then the regulating screw is fully unscrewed to its outer end position. If the control valve is opened only to such an extent that the braking device 22 is released but only a small amount of air is supplied to the motor 12, then the load is lowered at a suitable speed. If the control valve is opened more so that a larger amount of air is supplied to the motor, then the pressure to the braking device decreases and the lowering speed is again decreased. In order to cause the main valve 24 to open when the wire is unloaded it is necessary to fully screw home the regulating screw 25.

I claim:

1. In an overload protection device for preventing excess of allowed workload in air-operated lifting devices, such as winches, which comprise a drum (11) for carrying a wire (23) wound therearound, a motor (12) supplied by a compressed air source (14) for driving the drum, a control valve (13) for controlling the supply of compressed air to the motor, and a braking device (22) associated with the drum (11), said braking device being supplied with compressed air for releasing thereof upon actuation of the control valve (13), the improvement comprising:

a main valve (24) connected between the motor (12) and the compressed air source (14), and a load sensing device (17) which is arranged to adjust the main valve (24) by an air signal so as to stop the motor (12) due to overloading, the braking device (22) being adapted to be applied by venting through the main valve (24) upon an adjustment of the main valve (24) caused by the load sensing device (17).

2. A device according to claim 1, comprising an auxiliary valve (25) which is coupled in parallel interrelationship with the main valve (24).

3. A device according to claim 2, in which the braking device (22) is vented through the auxiliary valve (25).

4. A device according to claim 3, in which control air is supplied to the main valve (24) through a second control conduit (40) via the auxiliary valve (25) when the auxiliary valve is in a first position wherein the braking device (22) is vented.

5. A device according to claim 3 and 4, in which the auxiliary valve (25) is adjustable to a second position wherein it prevents venting of the braking device (22) and supplies compressed air to the control valve (13).

6. A device according to claim 5 in which the auxiliary valve (25) is adjustable to a third position wherein it supplies compressed air to both the control valve (13) and the braking device (22).

7. A device according to claim 6, in which the auxiliary valve (25) in its second and third positions is adapted to vent a first control conduit (30) which is connected to the load sensing device (17), thereby preventing adjustment of the main valve (24) to its position wherein it conducts compressed air to the control valve (13).

* * * * *